US007097591B2

(12) United States Patent
Moon

(10) Patent No.: US 7,097,591 B2
(45) Date of Patent: Aug. 29, 2006

(54) ADJUSTABLE STRIDE ELLIPTICAL MOTION EXERCISE MACHINE AND ASSOCIATED METHODS

(75) Inventor: Daniel Ross Moon, Riverside, IL (US)

(73) Assignee: True Fitness Technology, Inc., O'Fallon, MO (US)

( * ) Notice: Subject to any disclaimer, the term of this patent is extended or adjusted under 35 U.S.C. 154(b) by 531 days.

(21) Appl. No.: 10/636,316

(22) Filed: Aug. 7, 2003

(65) Prior Publication Data

US 2004/0097339 A1 May 20, 2004

Related U.S. Application Data

(60) Provisional application No. 60/401,601, filed on Aug. 7, 2002.

(51) Int. Cl.
*A63B 69/66* (2006.01)
*A63B 22/04* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 4,786,050 A 11/1988 Geschwender
5,685,804 A * 11/1997 Whan-Tong et al. ..... 482/51
5,759,136 A 6/1998 Chen
6,007,462 A * 12/1999 Chen ..... 482/57
6,042,512 A * 3/2000 Eschenbach ..... 482/52
6,183,398 B1 2/2001 Rufino et al.
6,248,046 B1 6/2001 Maresh et al.
6,277,054 B1 * 8/2001 Kuo ..... 482/51
6,302,830 B1 10/2001 Stearns
6,450,925 B1 * 9/2002 Kuo ..... 482/52
6,454,682 B1 * 9/2002 Kuo ..... 482/52
6,554,750 B1 4/2003 Stearns et al.
6,648,800 B1 11/2003 Stearns et al.
6,835,166 B1 12/2004 Stearns et al.
6,849,033 B1 * 2/2005 Stearns et al. ..... 482/52
2001/0023219 A1 9/2001 Lamb et al.
2002/0028731 A1 3/2002 Stearns

FOREIGN PATENT DOCUMENTS

TW 476279 2/2002

* cited by examiner

*Primary Examiner*—Stephen R. Crow
(74) *Attorney, Agent, or Firm*—Lewis, Rice & Fingersh, L.C.

(57) ABSTRACT

An elliptical exercise machine and methods for using the machine where the horizontal length of the stride of the ellipse can be adjusted by the user without the user having to alter the vertical dimension of the ellipse by an equivalent amount.

18 Claims, 16 Drawing Sheets

ADJUSTABLE STRIDE ELLIPTICAL MOTION EXERCISE MACHINE AND ASSOCIATED METHODS

CROSS REFERENCE TO RELATED APPLICATIONS

This application claims priority to U.S. Provisional Patent Application Ser. No. 60/401,601 filed Aug. 7, 2002 the entire disclosure of which is herein incorporated by reference.

BACKGROUND

1. Field of the Invention

This disclosure relates to the field of elliptical exercise machines. In particular, to elliptical exercise machines which allow for alteration in the shape of the foot path.

2. Description of the Related Art

The benefits of regular aerobic exercise on individuals of any age is well documented in fitness science. Aerobic exercise can dramatically improve cardiac stamina and function, as well as leading to weight loss, increased metabolism and other benefits. At the same time, aerobic exercise has often been linked to damaging effects, particularly to joints or similar structures where the impact from many aerobic exercise activities causes injury. Therefore, those involved in the exercise industry are continuously seeking ways to provide users with exercises that have all the benefits of aerobic exercise, without the damaging side effects.

Most low-impact aerobic exercises have traditionally been difficult to perform. Many low-impact aerobic exercises (such as those performed in water) traditionally require performance either outside or at a gym. Cold weather, other undesirable conditions, and cost can make these types of aerobic exercise unobtainable at some times and to some people. In order to allow people to perform aerobic exercises without having to go outside or to gyms or the like, fitness machines have been developed to allow a user to perform aerobic exercises in a small area of their home.

Many of these machines, however, suffer from either being relatively high-impact, or from being complicated to use and understand. In either of these cases, the fitness machine often becomes a coat rack instead of being used for its intended purpose. Recently, a class of machines which are referred to as "elliptical machines" or "elliptical cross-trainers" have become very popular due to their ease of use and their provision of relatively low-impact aerobic exercise.

Generally in these types of machines, a user performs a motion using their legs that forces their feet to move in a generally elliptical motion about each other. This motion is designed to simulate the motion of the feet when jogging or climbing but the rotational motion is "low-impact" compared to jogging or climbing where the feet regularly impact a surface. In an elliptical machine, a user uses a natural walking motion to instead move their feet through the smooth exercise pattern dictated by the machine. This motion may also be complemented by them moving their arms in a reciprocating motion while pulling or pushing various arms on the machine whose motion is connected to the motion of the feet, and vice-versa.

Currently, the biggest problem with elliptical machines is that the dimensions of the ellipse made by the user's feet are generally severely limited in size and shape by the design of the machine. The ellipses generated by these machines are often created by the interaction of a plurality of different partial motions, and attempts to alter the motion of a user in one dimension generally also alters the motion in another. It is desirable that users have the option to arrange the machine so that the ellipse can be tailored to fit their stride, but with machines on the market today, that generally is not possible.

The problem is most simply described by looking at the elliptical motion the feet make when using an elliptical exercise machine. This elliptical motion can be described by the dimensions of the ellipse. Since users generally stand upright on elliptical machines, the user's feet travel generally horizontally relative to the surface upon which the machine rests. This represents the users stride length or how far they step. Further, the user's feet are raised and lowered relative to the surface as they move through the ellipse. This is the height to which the user's feet are raised. How a user steps depends on the type of action they are performing. A more circular ellipse will often correspond more to the motion made while climbing, a slightly more elongated ellipse is more akin to walking, while a significantly elongated ellipse can be more akin to the motion of running.

Even within this limited framework, however, each user's stride length is different. A very short person will generally want all the dimensions of the ellipse to be smaller than someone who is very tall or has particularly long legs. In an elliptical machine, it therefore desirable that the length of the machine's "stride" correspond to the particular stride length of that user. Further, as a user's speed on the machine increases or decreases or as the resistance imparted by the machine increases or decreases, it can be desirable for the machine to alter the type of stride the user is making (by elongating or shortening the stride) to better correspond to a more natural movement.

In elliptical machines currently, the size and shape of the ellipse is generally fixed by the construction of the machine. That is, the footrests (the portion of an elliptical machine that will traverse the same ellipse as the user's feet) are generally forced to proscribe only a single ellipse when the machine is used and that ellipse is generally unchangeable. Some machines allow for some alteration of this ellipse, but generally those machines increase both dimensions of the ellipse, not just the horizontal component. That is, the user can adjust the total size of the ellipse, but the ratio of the ellipse's components always remains relatively constant.

This arrangement means that many users are not comfortable with the stride of an elliptical machine as it is either too long or too short for their stride. Even if the stride is adjustable, the user may still be uncomfortable. For some users, the stride will be much too short compared to their normal stride and attempts to increase the stride length result in their feet being raised uncomfortably high (e.g. turning a walking or jogging exercise motion into more of a climbing motion), while for others the same machine's stride can be much to long (resulting in overstretching of their legs as if they are running all the time). Further, a user may desire to tailor the machine's motion for the general type of exercise they want to perform (e.g., more jogging motion or more climbing motion) and may wish to alter the motion during an exercise session to have a more varied workout.

SUMMARY

Because of these and other problems in the art, described herein, among other things, are elliptical exercise machines where the length of the horizontal dimension (stride) of the ellipse can be adjusted by the user without the user having to alter the vertical dimension of the ellipse by an equivalent amount. This is generally referred to as having an "adjustable stride length" in the elliptical machine. This adjustment allows for a user to set a machine to a desirable shape for a particular type of motion regardless of their stride length.

There is described herein, in an embodiment, an elliptical exercise machine comprising: a frame; a crank arm rotationally connected to the frame at a crank pivot; a linear guide track attached to the frame; a main drive link attached at a distal end to the crank arm at a position spaced from the crank pivot; the main drive link attached at a proximal end so that the proximal end will linearly reciprocate in the guide track; a pendulum arm, connected at a first rotational axis to the frame, the distal end of the pendulum arm being rotationally connected to the proximal end of the main drive link via an interface having two independent rotation points; a footskate, the footskate capable of reciprocating movement on the main drive link; an adjustment arm, the adjustment arm connected at a second rotational axis, spaced from the first rotational axis, to the frame, the distal end of the adjustment arm being rotationally attached to the footskate via an interface having two independent rotation points; and a coupling connecting the adjustment arm to the pendulum arm so that when the pendulum arm moves about the first pivot axis, the adjustment arm also moves about the second pivot axis.

In an embodiment the position of the first rotational axis is adjustable relative the position of the second rotational axis such as through, but not limited to, the use of lift mechanism for adjusting the position of the first rotational axis relative to the second rotational axis which may include a hydraulic cylinder and be electrically or hand powered. In another embodiment, the first rotational axis is in a fixed position relative to the second rotational axis In another embodiment, the main drive arm includes a foot track and the footskate reciprocates in the foot track or the first rotational axis is spaced vertically from the second rotational axis and may not be spaced horizontally from the second rotational axis.

In another embodiment, the pendulum arm is bent away from the frame below the first rotational axis, and the adjustment arm rotates between the pendulum arm and the frame.

In another embodiment, the crank arm is attached to at least one of a flywheel and a resistance.

In another embodiment, a computer controls the machine. In another embodiment, the coupling is rotationally attached to the pendulum arm or the adjustment arm is rotationally attached to the coupling, and the adjustment arm can slide through the coupling.

In another embodiment, the machine also includes a second crank arm rotationally connected to the frame at the crank pivot, the second crank arm being arranged in a 180 degree relation to the crank arm; a second linear guide track attached to the frame; a second main drive link attached at a second main drive link distal end to the second crank arm at a position spaced from the crank pivot; the second main drive link attached at a second main drive link proximal end so that the second main drive link proximal end will linearly reciprocate in the second guide track; a second pendulum arm, connected at the first rotational axis to the frame, a distal end of the second pendulum arm being rotationally connected to the second main drive link proximal end via an interface having two independent rotation points; a second footskate, the second footskate capable of reciprocating movement on the second main drive link; a second adjustment arm, the second adjustment arm connected at the second rotational axis, spaced from the first rotational axis, to the frame, a distal end of the second adjustment arm being rotationally attached to the second footskate via an interface having two independent rotation points; and a second coupling connecting the second adjustment arm to the second pendulum arm so that when the second pendulum arm moves about the first pivot axis, the second adjustment arm also moves about the second pivot axis.

In still another embodiment, there is herein described, a method of altering the stride length of an elliptical exercise machine during an exercise, the method comprising: providing an elliptical exercise machine including: a frame; a crank arm rotationally connected to the frame at a crank pivot; a linear guide track attached to the frame; a main drive link attached at a distal end to the crank arm at a position spaced from the crank pivot; the main drive link attached at a proximal end so that the proximal end will linearly reciprocate in the guide track; a pendulum arm, connected at a first rotational axis to the frame, the distal end of the pendulum arm being rotationally connected to the proximal end of the main drive link via an interface having two independent rotation points; a footskate, the footskate capable of reciprocating movement on the main drive link; an adjustment arm, the adjustment arm connected at a second rotational axis, spaced a first length from the first rotational axis, to the frame, the distal end of the adjustment arm being rotationally attached to the footskate via an interface having two independent rotation points; and a coupling connecting the adjustment arm to the pendulum arm so that when the pendulum arm moves about the first pivot axis, the adjustment arm also moves about the second pivot axis; having a user on the exercise machine move their feet so that during the exercise the footskate reciprocate on the main drive link a first distance; and altering a position of the second rotational axis so that the second rotational axis is spaced a second length from the first rotational axis, the second length being greater than the first length.

In yet another embodiment, there is herein described, an elliptical exercise machine comprising: a frame; a main drive link having a proximal and a distal end; means for rotating the distal end of the drive link about an axis of rotation; means for linearly reciprocating the proximal end of the main drive link; a footskate mounted on the main drive link; means for linearly reciprocating the footskate on the main drive link while the proximal end of the main drive link is linearly reciprocating.

BRIEF DESCRIPTION OF THE DRAWINGS

FIG. 3 has the protective covers in place.

FIG. 5 provides a simplified side view of movement of the pendulum arms and adjustment arms.

DESCRIPTION OF PREFERRED EMBODIMENT(S)

Although the machines, devices, and methods described below are discussed primarily in terms of their use with a particular layout of an elliptical exercise motion machine where a rotational wheel is on the back of the machine and the machine utilizes handgrip pendulum arms, one of ordinary skill in the art would understand that the principles, methods, and machines discussed herein could be adapted, without undue experimentation, to be useable on an elliptical motion machine which generates its elliptical motion through the use of a forward mounted wheel or through any other manner and can similarly be adapted to elliptical machines that do not use handgrip pendulum arms.

The invention disclosed herein primarily relates to elliptical exercise machines where the stationary footrest of the prior art is replaced by a reciprocating footskate traversing a linear portion of a main drive link. The motion provides for the ability to alter the horizontal stride of the user utilizing the machine, without significantly altering their vertical stride height on the machine.

For the purposes of this disclosure, the terms horizontal and vertical will be used when referring to the dimensions of the ellipse drawn by the user's feet. One of ordinary skill in the art will understand that depending on the arrangement of the parts and how the machine is used, the ellipse traversed by the user's feet may be at an angle to the vertical and horizontal. That is, a line connecting the two axes of the ellipse may not be completely horizontal or completely vertical, or in some cases it may be. For the purposes of this disclosure, when the horizontal dimension of the ellipse is referred to, it is referring to the longest dimension of the ellipse (line through both axes), and the vertical dimension is the shortest dimension of the ellipse (line evenly spaced between the two axes). These dimensions are not used to strictly mean horizontal and vertical relative to the earth. Further, most of this discussion will refer to the operation of a single side of an exercise machine, one of ordinary skill in the art would understand that the other side will operate in a similar manner.

Figure 1:
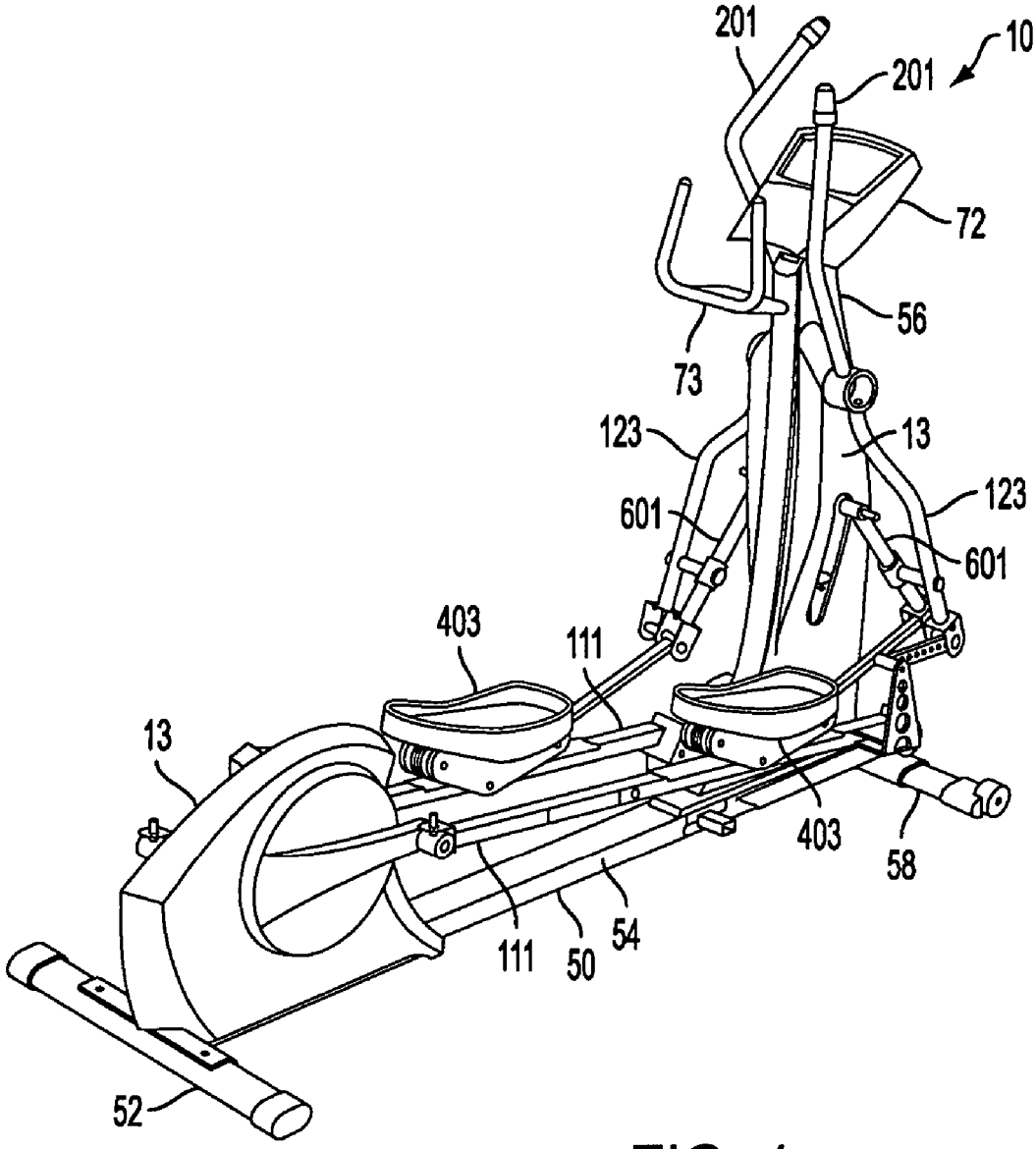
FIG. 1 provides a rear perspective view of an embodiment of an adjustable stride elliptical exercise machine.
Figure 2:
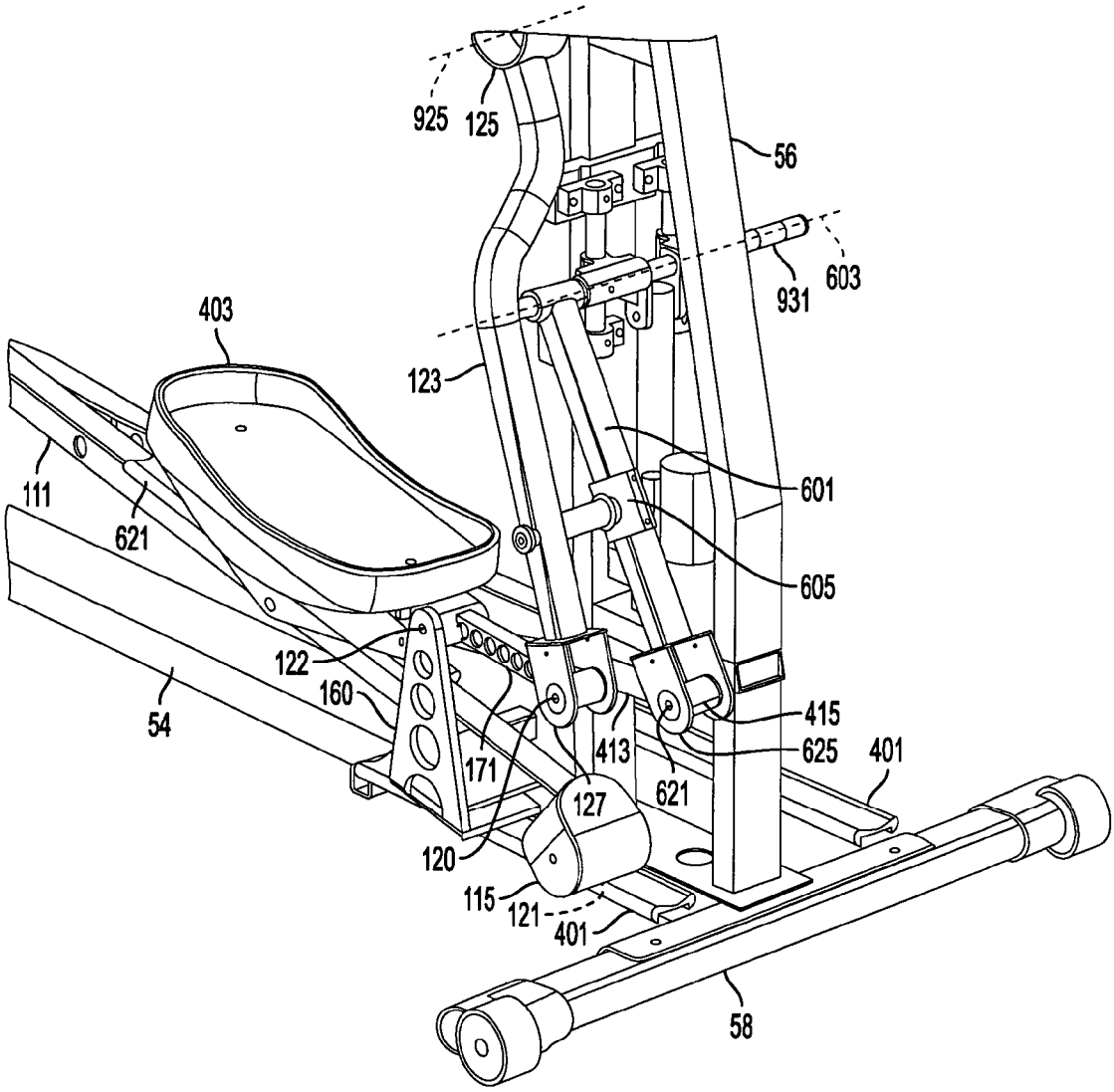
FIG. 2 provides a front perspective view of the embodiment of FIG. 1 with the protective covers removed showing the detail of the front portion.

FIG. 1 depicts an embodiment of an elliptical motion exercise machine (10) including an adjustable stride system. The exercise machine (10) is comprised of a frame (50) of generally rigid construction which will sit stably on a surface to provide for the general shape of the machine (10) as shown in FIG. 1. The frame (50) is generally constructed of strong rigid materials such as, but is not limited to, steel, aluminum, plastic, or any combination of the above. The frame (50) may be of any shape, but will generally be designed to provide a place to attach the remaining components and to provide a structure which can resist damage or breakage from repeated use by the individual exercising thereon. The frame (50) will also generally be designed so as to stably support a user utilizing the exercise machine (10) and prevent the machine from having undue sway or other undesirable motion while the user is exercising. In the depicted embodiment, frame (50) includes four major substructures, a rear stabilizer bar (52), a main frame beam (54), a vertical riser (56) and a front stabilizer bar (58).

The rear stabilizer bar (52) and the front stabilizer bar (58) will generally rest on the surface upon which the exercise machine (10) is placed. This surface will generally be flat. One of ordinary skill in the art would understand that the surface need not be flat as the position of the machine is only important relative to the user but, for clarity, this disclosure will presume that the machine is placed on a generally flat surface. The front stabilizer bar (58) and the rear stabilizer bar (52) are then held at a position spaced apart from each other by the main frame beam (54). This provides the frame (50) with a generally planar "I"-shape base and provides for a structure which is generally sufficiently solid to not rock or sway when in use. The vertical riser (56) extends generally away from the surface on which the machine is resting and generally extends from the main frame beam (54) and/or the front stabilizer bar (58) at a point around the front of the frame (50). The vertical riser (56) may be topped by a computer control panel (72) for controlling the functions of the machine (10) as known to those of ordinary skill in the art.

In an embodiment, the frame (50) may include additional components, or not include any of the above components. Further, any portion of the frame (50) may be covered by a cover (13) which may not provide for specific strength and support of the other components of the machine (10), but may serve to cover operating or moving parts of the machine (10) for aesthetic or safety purposes such as to keep an individual's clothing from becoming trapped in the machine (10) or simply to give the machine a particular "look." The machine may also include a non-moving grip (73) which the user can grasp for balance instead of using the pendulum arms (123).

As best shown in FIG. 8, attached toward the rear stabilizer bar (52) at a position vertically separated from the rear stabilizer bar (52) there is a crank pivot (101), to which are attached two crank arms (103). The crank pivot (101) is attached to the crank mount (52) in a manner so that the crank pivot (101) can rotate about a singular axis of rotation. This axis is generally perpendicular to the line between the rear stabilizer bar (52) and the forward footpad (58) (which is in turn generally horizontal). Each of the crank arms (103) is of a generally rigid linear construction and is rigidly attached to the crank pivot (101) at a generally central location (105). Spaced from the generally central location (105) is a first end (107) of the crank arms (103). As shown in FIG. 1 the first ends (107) will generally be arranged with each other such that the structure of the crank arms (103) and the crank pivot (101) are generally co-planar, but this is by no means necessary. The crank arms (103) will generally rotate about the crank pivot (101) in this fixed relationship with each other. In particular, the first ends (107) of the crank arms (103) will traverse a circle about the crank pivot (101), and the first ends (107) will be at a 180 degree angle relative to each other (that is they will always be on opposing sides of the circle, connected with a line through the center of the circle, regardless of their position on the circle).

Attached to each of the crank arms (103) at the first end (107) is a main drive link (111). The main drive link (111) will generally be of significantly greater length than the crank arm (103) and will be attached to the appropriate crank arm (103) at the main drive link's (111) distal end (117) through a support pivot (113). The support pivot (113) will generally have an axis of rotation parallel to the crank pivot (101) and provides a single axis of rotation relative to the first end (107) of the crank arm (103) and allows the main drive link (111) and the crank arm (103) to freely rotate about each other at that axis of rotation.

At the proximal end (115) of the main drive link (111), the main drive link (111) has a wheel (121) or similar structure which allows the main drive link's (111) proximal end (115) to slide on, in or otherwise be constrained to linear movement by a linear guide track (401). Obviously, this movement need not be completely linear, but is preferred to be considered generally linear. It is preferred that this guide track (401) be arranged generally parallel with the plane of the "I" portion of the frame (50) so that the proximal end (115) of the main drive link (111) moves in a generally linear path parallel to the flat surface upon which the machine rests. In the depicted embodiment, the guide track (401) comprises a trough of material in which wheel (121) at the proximal end (115) of the main drive link (111) rides, but this is by no means required and other tracks could be used. The use of a guide track (401) provides for much smoother motion and less wobble in the machine than free swinging arms.

Further the shape of the resultant exercise motion is altered as will be discussed later. When a linear guide track (401) is used, the motion of the proximal end (115) of the main drive link (111) is one-dimensional reciprocating movement. In particular, the proximal end (115) does not move in the vertical dimension. The main drive link (111) is of a generally linear shape over most of its length, but may be bent toward either end. The main drive link (111) may also include, towards its proximal end (115), a vertical brace (160) to provide for the connection to the connector (171).

The proximal end (115) of the main drive link (111) is attached to the distal end (129) of pendulum arm (123) through a double rotationally jointed connector (171). The pendulum arm (123) is an arm designed to provide for pendulum motion, or arcuate motion about a fixed axis parallel to the surface upon which machine (10) rests. To provide the pendulum motion, pendulum arm (123) is connected about a first axis of rotation (925) to the vertical riser (56) at a pendulum pivot (125) vertically and horizontally spaced from the crank pivot (101). In the depicted embodiment, this position is above the crank pivot (101) but one of ordinary skill in the art would recognize that similar pendulum motion could be obtained using an axis below the crank pivot (101) and inverted pendulum motion. The pendulum arm (123) is preferably bent so as to be directed away from the vertical riser (56). In this way the adjustment arm (601) (discussed later) rotates in the space between the pendulum arm (123) and the vertical riser (56). This is, however, by no means required, and in an alternative embodiment, the pendulum arm (123) may be linear and simply extended from the vertical riser (56) a sufficient distance to clear the adjustment arm (601). In a still further embodiment, the adjustment arm (601) may be positioned beyond or before the pendulum arm (123) so as to rotate in a different area eliminating any need for the pendulum arm (123) to be bent.

The pendulum arm (123) is attached to the connector (171) at the distal end (129) by a first pivot (120) a first distance $D_1$ from the pendulum pivot (125). The distance $D_1$ will generally be significantly greater than the radius of the circle formed by the crank arms (103). In particular, $D_1$ is greater than the length of the crank arms (103). The connector (171) is then attached to the vertical brace (160) and thus the main drive link (111) at a second pivot (122). The use of this connector (171) allows for the proximate end (115) of the main drive link (111) to traverse a completely linear path, even though the distal end (129) of the pendulum arm (123) traverses a rotational path.

As should be apparent from this structure, the main drive link (111) is effectively positioned between the crank arm (103) and the guide track (401). The pendulum motion of the pendulum arm (123) can be used as a fulcrum lever to drive the main drive link (111) in a generally reciprocating motion back and forth along the guide track (401). The basic motion of the main drive link (111) should also be clear. In particular, the distal end (117) of main drive link (111) will trace an endless circle, while the proximal end (115) of the main drive link (111) will trace a linear line corresponding to the guide track (401). Therefore any point in the middle of the main drive link (111) will trace an ellipse with a major dimension generally parallel to the guide track (401)

Figure 3:
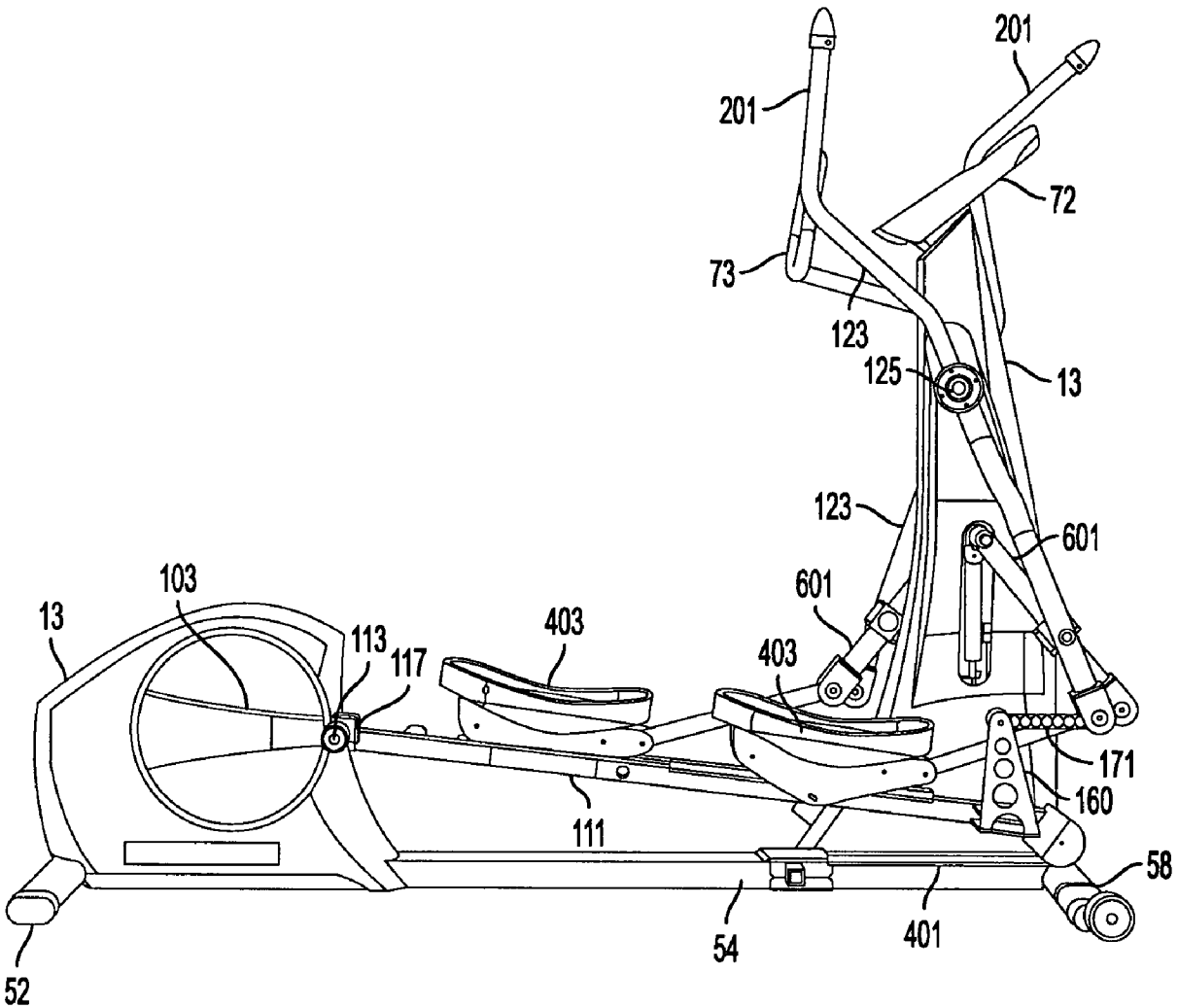
FIG. 3 provides a side view of the device of FIG. 1.
Figure 4:
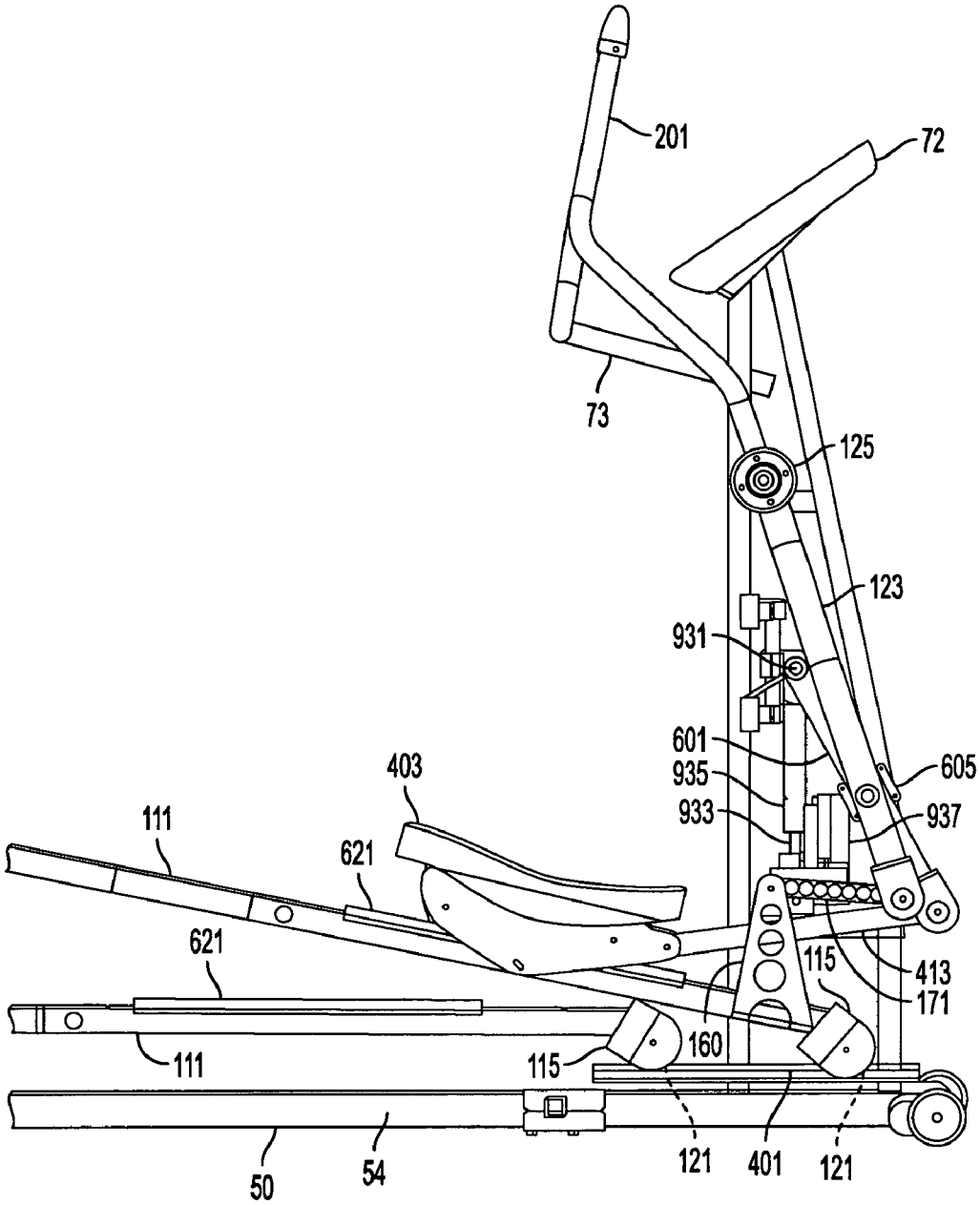
FIG. 4 provides for a detailed view of the lift mechanism in the embodiment of FIG. 2.

The motion of the two ends of the main drive link (111) is therefore in a fixed interrelation. When the crank arms (103) are horizontal, the proximal ends (115) of the support arms (111) are each at the extremes of their linear positioning. To put another way, one is at the "front" edge or the edge to the right of FIG. 3 while the other is at the "back" edge, or the edge to the left of FIG. 3. When the crank arms (103) are vertical, both support arms (111) are at the midpoint of their linear paths (although are instantly moving in opposite directions).

If one were to take a fixed point on main drive link (111) generally towards the center between the distal end (117) and proximal end (115) of the main drive link (111) and trace its motion as the main drive link (111) moves as described, it would be apparent that the point would generally trace an elliptical pattern through the movement. The motion of the main drive link (111) therefore can supply an elliptical motion for the user using the machine (10). The user need simply stand on the main drive link (111) with their feet at the fixed points on the main drive link (111), face the front (or back) of the machine (10) and move their feet in a manner to correspond to the elliptical motion of that point.

The pendulum arm (123) extends beyond the pendulum pivot (125) and terminates in a hand grip (201) which can be grasped by the user during performance of the exercise to both steady their body when performing the exercise, and to allow the user to use their arm muscles to help drive the motion of the main drive link (111). As can be seen from the FIGS., a user pushing back and forth on the pendulum arms (123) will impart that motion to the proximal end (115) of the main drive link (111) (in the manner of a fulcrum lever), reciprocating the main drive link (111). Alternatively, a user could move the main drive link (111) directly (by placing their feet on it) and reciprocate it directly. Alternatively the crank arms (103) could be rotated directly. As should be clear, any of these motions imparts any of the other motions. In particular, the proximal end (115) of the main drive link (111) reciprocates along a linear path. Any of the above could be used depending on the embodiment by the user to drive the machine.

One of skill in the art would also recognize that the crank pivot (101) and/or other portions of the crank mechanism can comprise additional structure. In particular, in an embodiment, the crank arms (103) can be connected to a flywheel (181) or similar structure to help them to rotate about the crank pivot (101) even when no force is placed upon the main drive link (111) to get it to move. This flywheel (181) can be used to provide for a smoother exercise as the power generated by the force of the user may be stored and reused to smooth out the motion of the main drive link (111) when the user is striding on the machine. In another embodiment, the crank arms (103) may be required to work against a resistance (183) that hinders them from reciprocating the main drive link (111). This resistance (183) can be of any type known to those of ordinary skill in the art including, but not limited to, friction, the return of force of a spring, or electromechanical resistance. The resistance (183) forces the user to supply additional energy to reciprocate the main drive links (I 1) and move their feet in the elliptical motion, resulting in a more difficult exercise.

The above description has related to the general layout of an exercise machine that can perform elliptical motion. The problem, as described previously, is that this elliptical motion is of fixed dimensions and ratios. In particular, the above description relates to the motion of a fixed point on the main drive link (111). While this motion can be adjusted by such things as altering the length of the main drive link (111), the distance $D_1$, or the length of crank arms (103), these changes are generally difficult to perform and generally alter the entire shape of the ellipse, not just the horizontal dimension of the ellipse. Further, these changes cannot generally be performed while the machine is in use. Therefore, a machine having only these structures has an essentially fixed ellipse of motion and that ellipse is essentially fixed in its relative dimensions.

As shown in FIG. 1, the motion can be made adjustable in the horizontal dimension, without having a corresponding alteration in the vertical dimension, by allowing the footskate (403) to reciprocate on a foot track (621) on the main drive link (111) during the exercise. This reciprocating movement may complement the motion of the main drive link (111) to increase the horizontal dimension, or may work against the reciprocating motion of the main drive link (111) to decrease the horizontal dimension. In particular, if one were to select the particular fixed point, the reciprocating motion allows the user's foot to traverse a distance across that fixed point so that the user's foot has always moved a fixed distance relative to the fixed point for a particular location on the ellipse.

This reciprocating motion allows for the user's stride length to be increased by increasing the reciprocation or shortened by shortening the reciprocation (or even partially reversing it) so that it is comfortable to the user without their having to alter the vertical dimension of the ellipse. In the depicted embodiment the adjustable stride length is provided through the use of an adjustment arm (601) which also provides pendulum motion, but because of its positioning and arrangement provides a different horizontal component of motion than the pendulum arm (153).

The adjustment arm (601) is attached to the vertical riser (56) so as to rotate about a second axis of rotation (603). This second axis of rotation (603) is physically created by rotational attachment to a rotational bar (931). The second axis of rotation (603) is parallel to and spatially separated from the first axis of rotation (925) about which the pendulum arm (123) rotates. While spatial separation could be in any direction, it is preferable that the axes be vertically separated so as to provide for a more controllable result, but in an alternative embodiment they could be separated in any manner. The adjustment arm (601) then extends downward through a coupling (605) until it reaches a distal end (625) and a secondary pivot (621).

The secondary pivot (621) is rotationally attached to a rigid transfer arm (413) which is in turn rotationally attached to a footskate (403) which is a footrest which can linearly reciprocate on a foot track (621) arranged on at least the portion of main drive link (111) which is generally linear over a foot track (621). This reciprocating sliding motion may be provided through the use of structures similar to those used in the guide track (401) and proximal end (115) of the main drive link (111) or through other structures. The distal end (615) of the adjustment arm (601) is attached to the first end (415) of transfer arm (413) by secondary pivot (621). The second end (417) of transfer arm (413) is attached by footskate pivot (431) to footskate (403). The footskate (403) in the depicted embodiment is allowed to traverse a portion of the main drive link (111) by sliding or rolling along foot track (621) which is essentially the upper surface of the main drive link (111). It should be recognized that the footskate (403) cannot separate from the main drive link (111), and is only allowed movement along the elongate dimension of the main drive link (111) which is preferably linear. The footskate (403) to adjustment arm (601) connection therefore utilizes the same two axis motion transfer as the pendulum arm (123) to the main drive link (111).

The reciprocating footskate (403) allows for control of the horizontal dimension of the ellipse without increase in the vertical dimension of the ellipse. Further, the linear relationship of the proximal end (115) of the main drive link (111) also helps to make the ellipse more true by eliminating the effect of the pendulum arm (123) rotation. The alteration of the motion is caused by the relationship between the linear motion of the footskate (403) and the motion of the main drive link (111). As should be apparent from the pictures, because the footskate (403) is effectively reciprocated by a different pendulum motion, the footskate (403) moves in a reciprocating pattern dictated by the location of the second axis (603), not by the position of the first axis (925).

The motion relates because of the percentage of arc length, and the actual arc length traversed by distal end (415) of the adjustment arm, compared to the distal end (129) of the pendulum arm (123). In this situation, the coupling (605) helps to dictate the relationship between the two distal ends. As can be seen from the figs, the coupling (605) comprises a multi directional pivot allowing both the pendulum arm (123) and the adjustment arm (601) to rotate about their individual axes while the coupling (605) also serves to transfer rotational motion from one of the two arms (pendulum arm (123) and adjustment arm (601)) into rotational motion of the other arm, but at a different rate. The coupling (605) will generally be located at a fixed distance from one of the two axes (603) and (925).

Figure 5A:
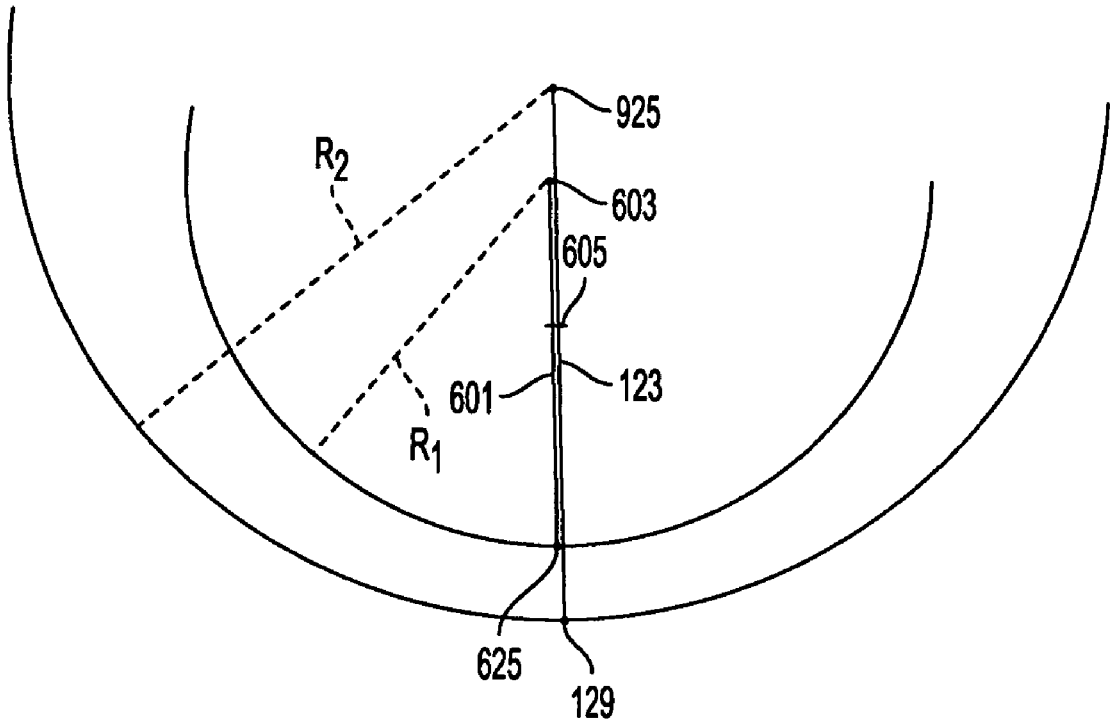
FIG. 5A shows a midpoint position.
Figure 5B:
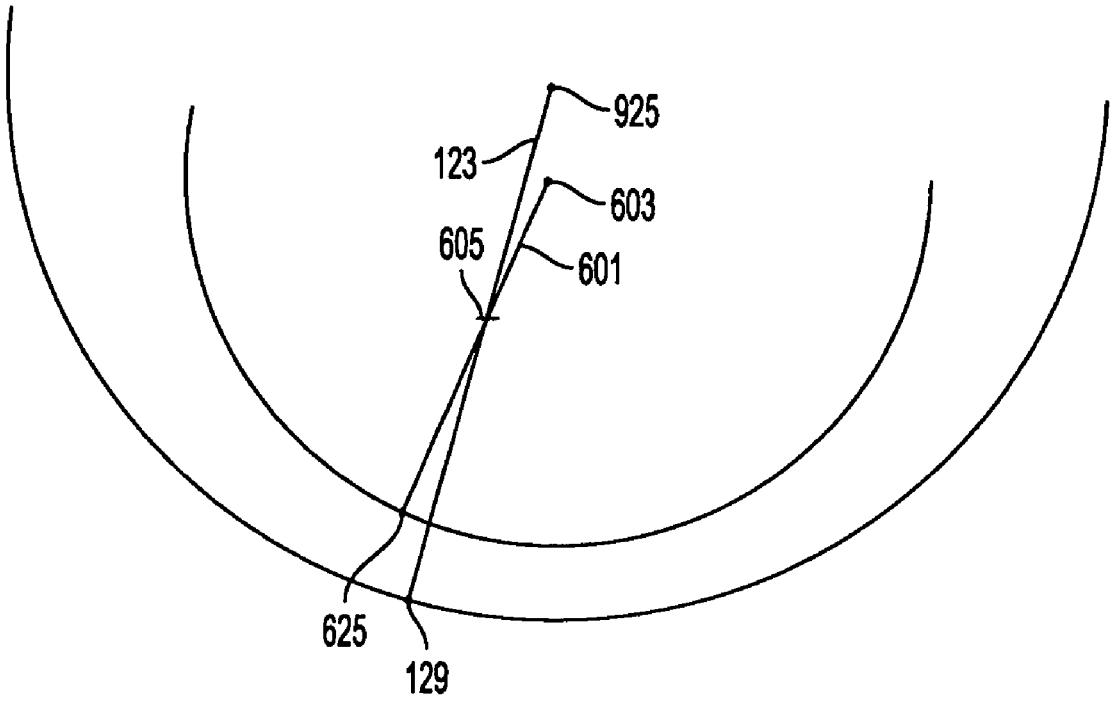
FIG. 5B shows a forward position.
Figure 5C:
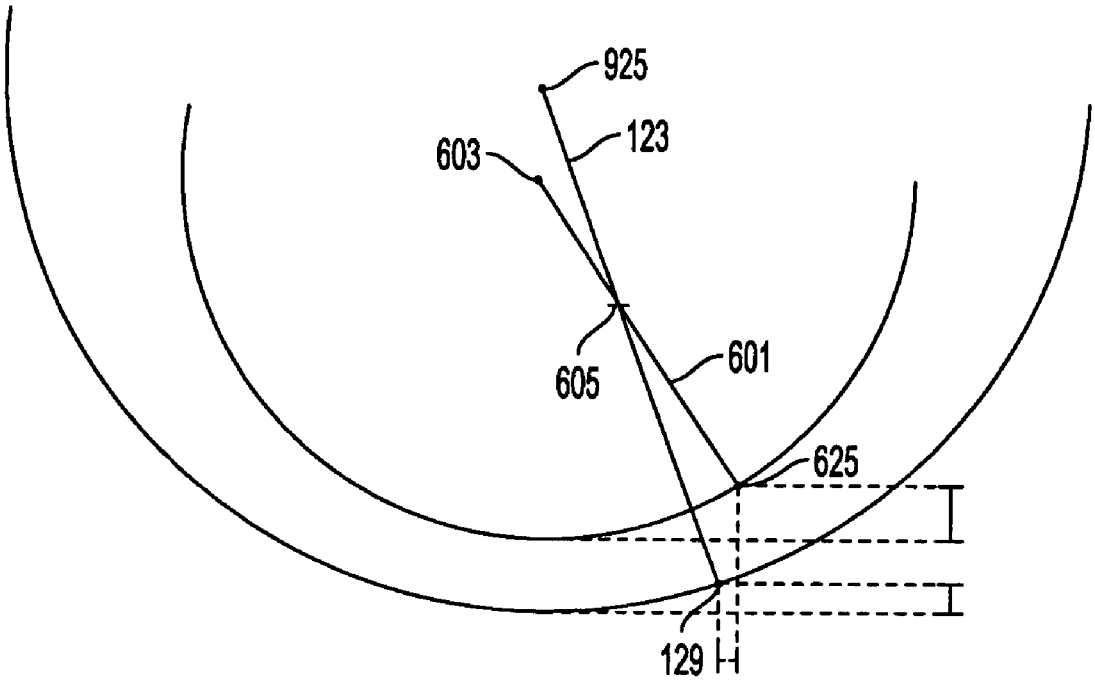
FIG. 5C shows a backward position.
Figure 6A:
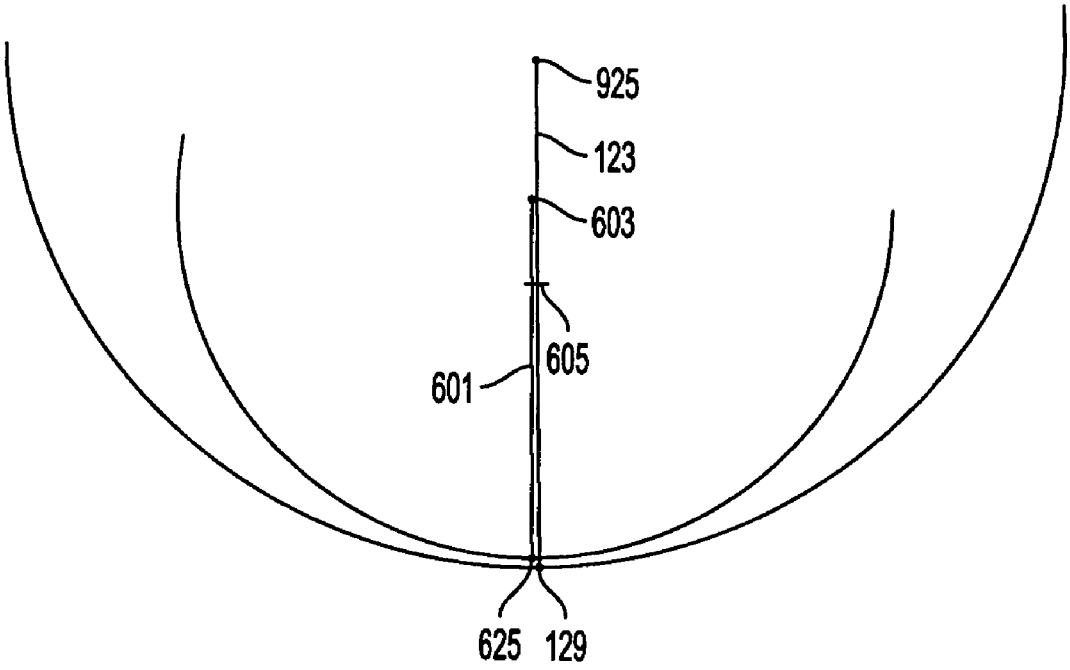
FIG. 6 shows the same three side views as FIG. 5 in the same order, but the adjustment arm axis and adjustment arm have been moved downward.
Figure 6B:
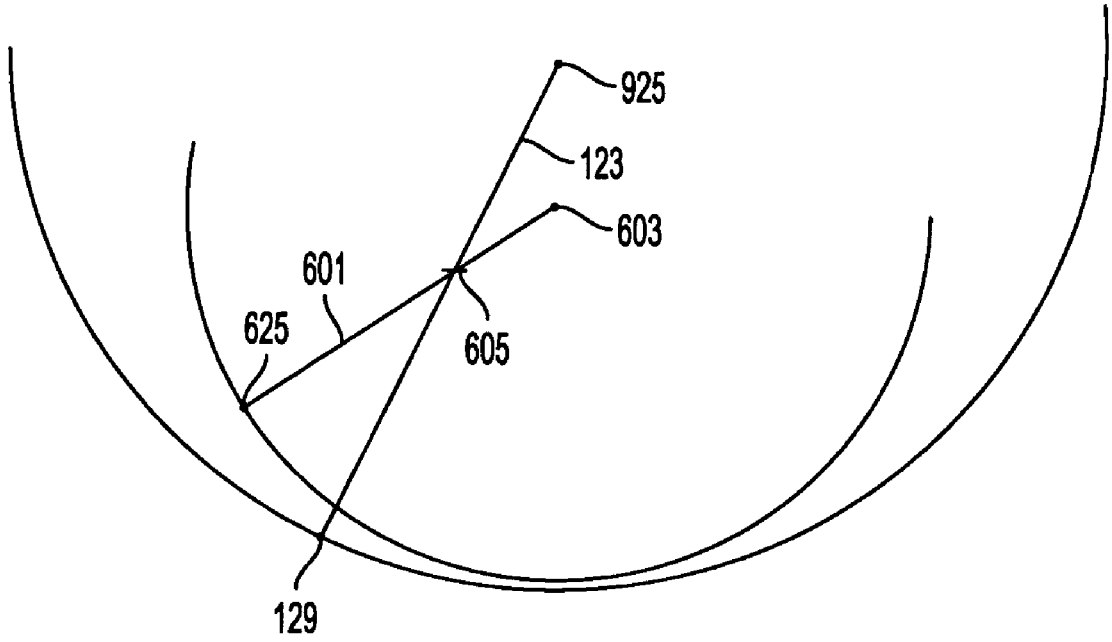

FIGS. 5 and 6 show how this can effect the motion of the pendulum arm (123) and adjustment arm (601) in a simple case. In FIG. 5A there is shown two circles. The first circle has a radius of $R_1$ while the second circle has a radius of $R_2$ where $R_2$ is greater than $R_1$. Further the axis of the circle with the smaller radius is vertically transposed below the axis of the circle with the larger radius. The circle of radius $R_2$ corresponds to the path of the distal end of the pendulum arm (123) while the circle of radius $R_1$ correspond to the path of the distal end of the adjustment arm (601). At the instant shown in FIG. 5A there is a line drawn to each of the circles representing the portion of the pendulum arm (123) and adjustment arm (601) below its appropriate pivot. The point of intersection in turn corresponds to the location of the coupling (605). This location is a fixed distance down the pendulum arm (123) but the adjustment arm (601) can slide relative to the coupling (605). In an alternative embodiment the coupling could be fixed to the adjustment arm (601) and slide relative to the pendulum arm (123). Progression of the figures now shows the difference in movement for the two different distal ends. As you can see at the forward position of FIG. 5B, the intersection point of the smaller circle is more to the left of the intersection point of the line to the larger circle. In FIG. 5A, the intersections are similar and FIG. 5C both are extended to the right.

One of ordinary skill in the art would understand the relationship between the distances will depend on a multitude of factors, but that the effect can be fairly easily determined. In particular, returning to FIG. 5 and now comparing to FIG. 6, as the distance between the two axes increases, the horizontal length traced by the adjustment arm (601) will increase relative to the pendulum arm (123). Further, as the coupling (605) moves towards the axis (603) of the adjustment arm (601), the horizontal length traced by the adjustment arm (601) will increase relative to the pendulum arm (123). Obviously, when moving in the opposite direction, the opposite is true. A comparison of FIG. 5C to FIG. 6C shows how the amounts of circles traversed (and the vertical and horizontal components of that traversal) changes with the movement of coupling (605) and axis (603).

Figure 6C:
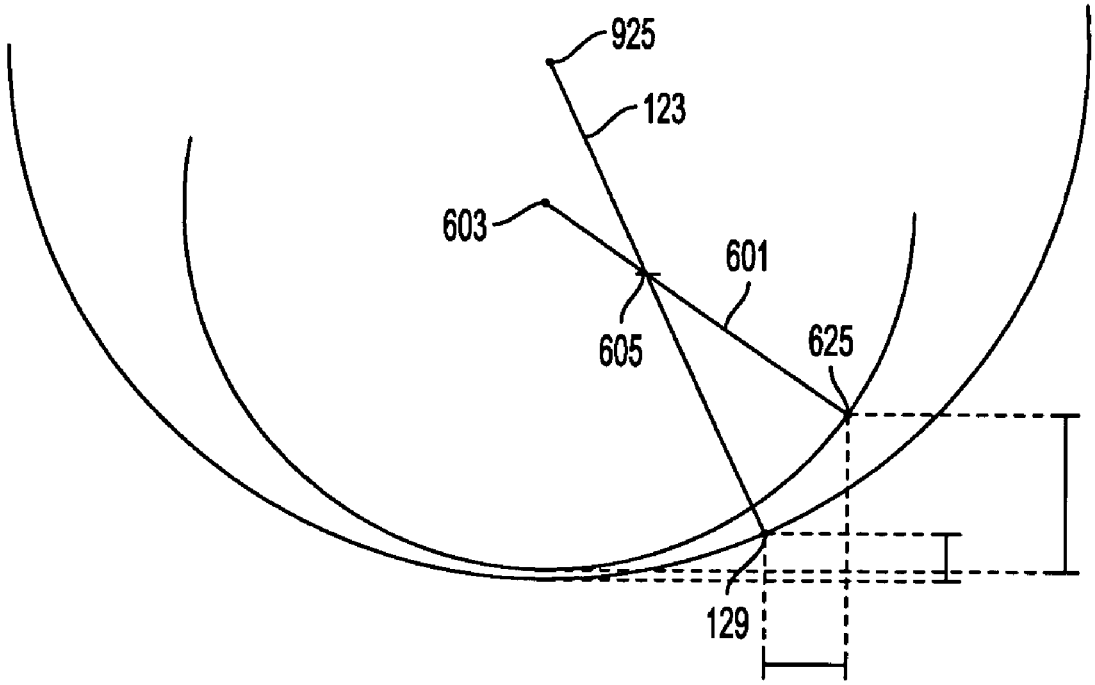

As should be clear from the simplified drawings of FIGS. 5 and 6, the dual arm arrangement shown in FIGS. 1–4 provides for the footskate to reciprocate a different amount than a fixed point on the main drive link (111). This is shown in the comparisons of FIG. 8. The guide track (401) and the footskate's (403) reciprocating motion now provide for the next part of the motion. As should be clear from FIGS. 1–4, at the vertical position of the arms (FIG. 5A) the guide track (401) is generally perpendicular to the position of the pendulum arm (123) and adjustment arm (601). One of ordinary skill in the art would recognize that this is a simplification, as the pendulum arm (123) need not be straight between the axis (925) and distal end (129), but it provides the relevant understanding. As the guide track (401) defines the one directional path of motion of the proximate end (115) of the main drive link (111), it is clear that the only relevant motion of the FIGS. 5C and 6C, is the horizontal motion. Any change in vertical motion (shown as the vertical lines) is eliminated.

The use of the guide track (401) therefore prevents imparted vertical motion from the rotation of the pendulum arm (123) and adjustment arm (601) to be provided to the footskate (403). The distal end of the pendulum arm (123) rotates through the part circle shown in FIG. 5 or FIG. 6. However due to the rotational connection to the main drive link (111), and the guide track (401) via the double axis connection, the vertical components are eliminated. Further, because the footskate (403) can only traverse the main drive link (111) and is connected to the adjustment arm (601) through a similar two axis connection, the footskate (403) can also not obtain any vertical motion from the movement of the pendulum arm (123) or the adjustment arm (601).

This design provides for a much cleaner elliptical motion even at the extremes of the stride length without the motion having undesirable vertical change because of the vertical translation of the distal end (129) of the pendulum arm (123) or the distal end (603) of the adjustment arm (601). Motion in the vertical direction applied to the footskate (403) is imparted by the radius of the rotation of the crank arms (103). The guide track (401) prevents motion from the pendulum arm (123) in the vertical direction and holding the footskate (403) on the main drive link (111) prevents vertical motion from being imposed from the adjustment arm's (601) rotation. What should be clear from this discussion, is that the dual arm arrangement in conjunction with the dual axis connector systems and the linear tracks means that the stride length can be increased without effecting the vertical component of the elliptical motion.

That is, the footskate (403) simply allows for the feet of the user to move further apart along the main drive link (111) during the stride. This increases the length of the step in a natural way. In other systems the resultant foot motion would incorporate some of the height change of both the pendulum arms (123) and the adjustment arms (601) resulting in a less natural transition as the foot would be raised higher, in addition to stretching out the stride. The inclusion of the guide track (401) and foot track (621) and dual axis connectors eliminates this issue providing for a more natural exercise motion. Further, arms which are free swinging, produce more of a "kidney-shaped" path as opposed to a true ellipse.

Figure 7:
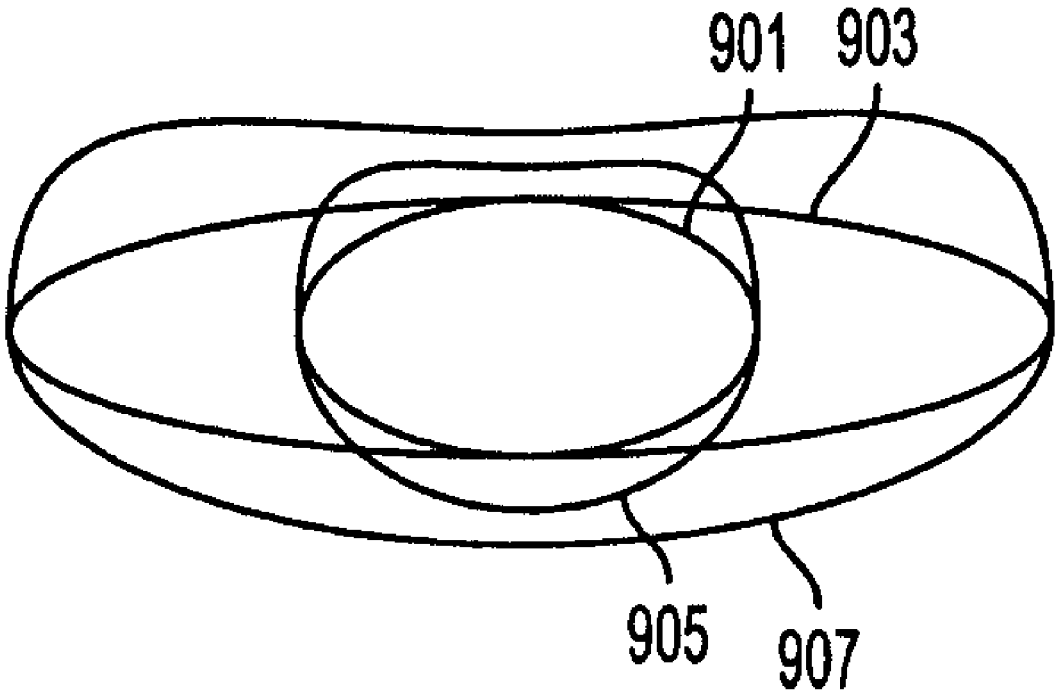
FIG. 7 shows ellipses representative of different systems.
Figure 8A:
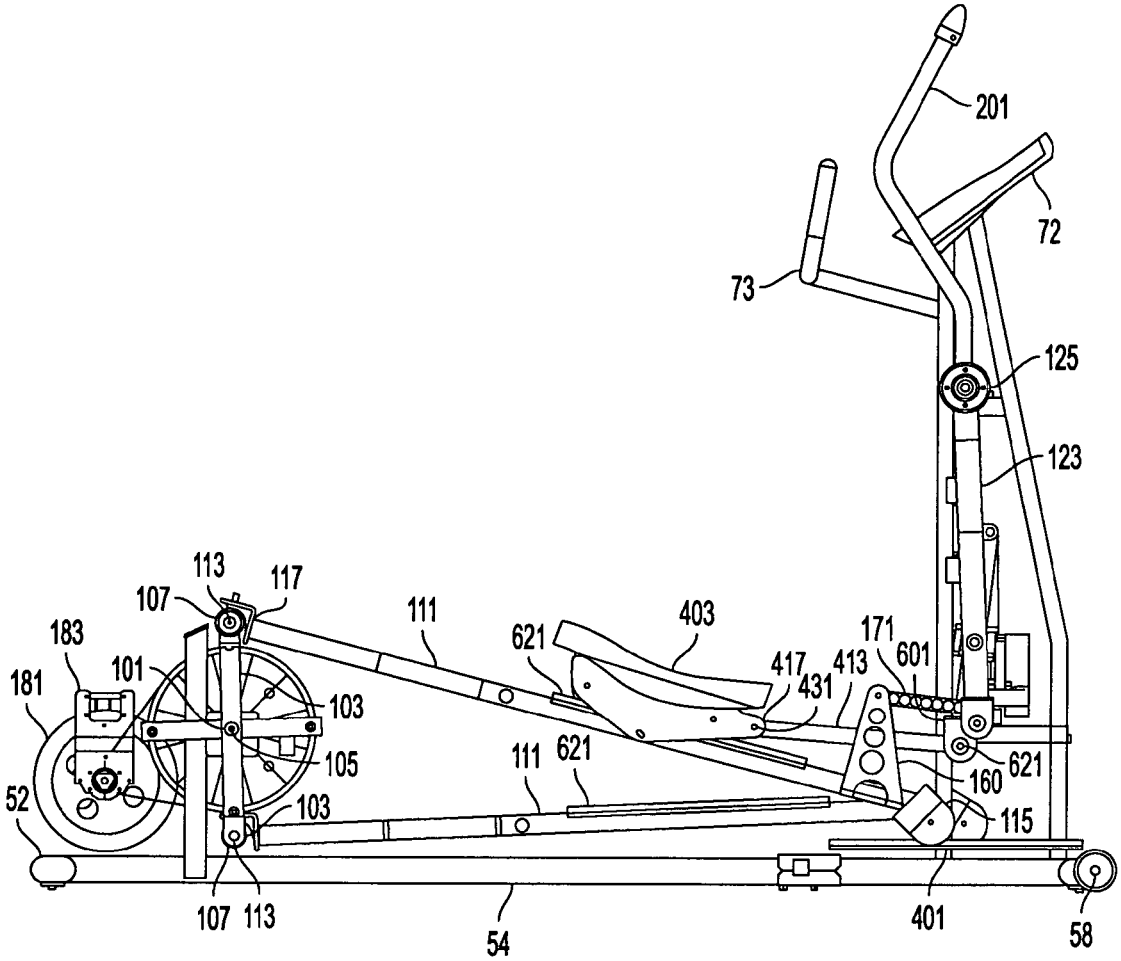
FIG. 8 shows the embodiment of FIG. 3 with the covers removed and in five different successive positions of motion, labeled 8A, 8B, 8C, 8D, and 8E. One side of the machine has been mostly removed for clarity.
Figure 8B:
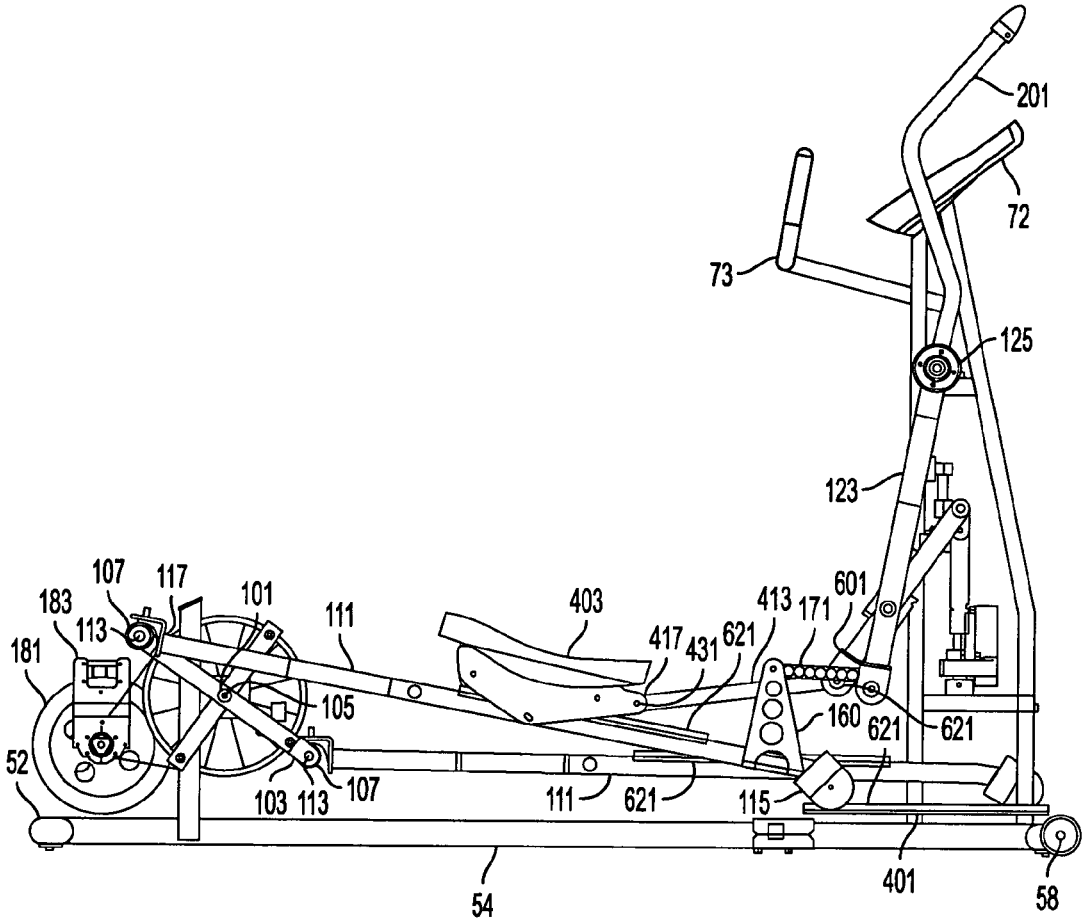
Figure 8C:
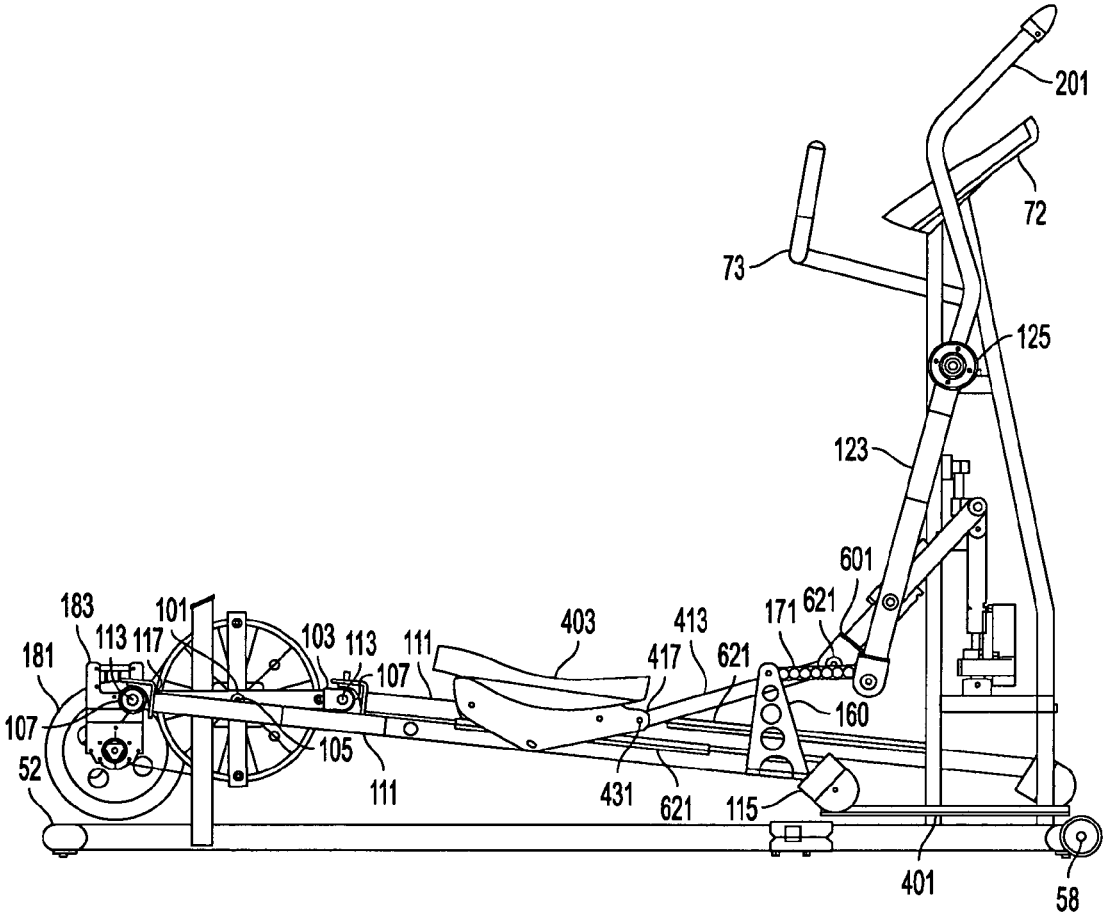
Figure 8D:
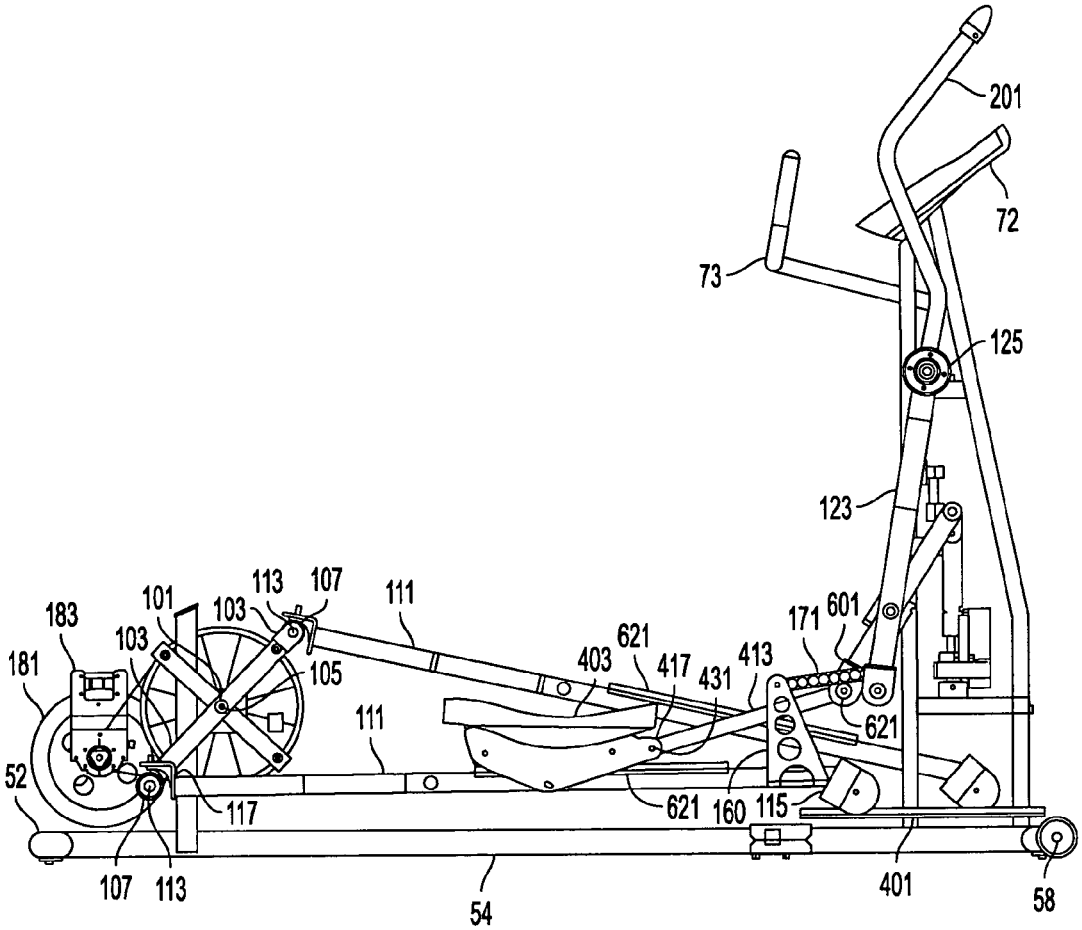
Figure 8E:
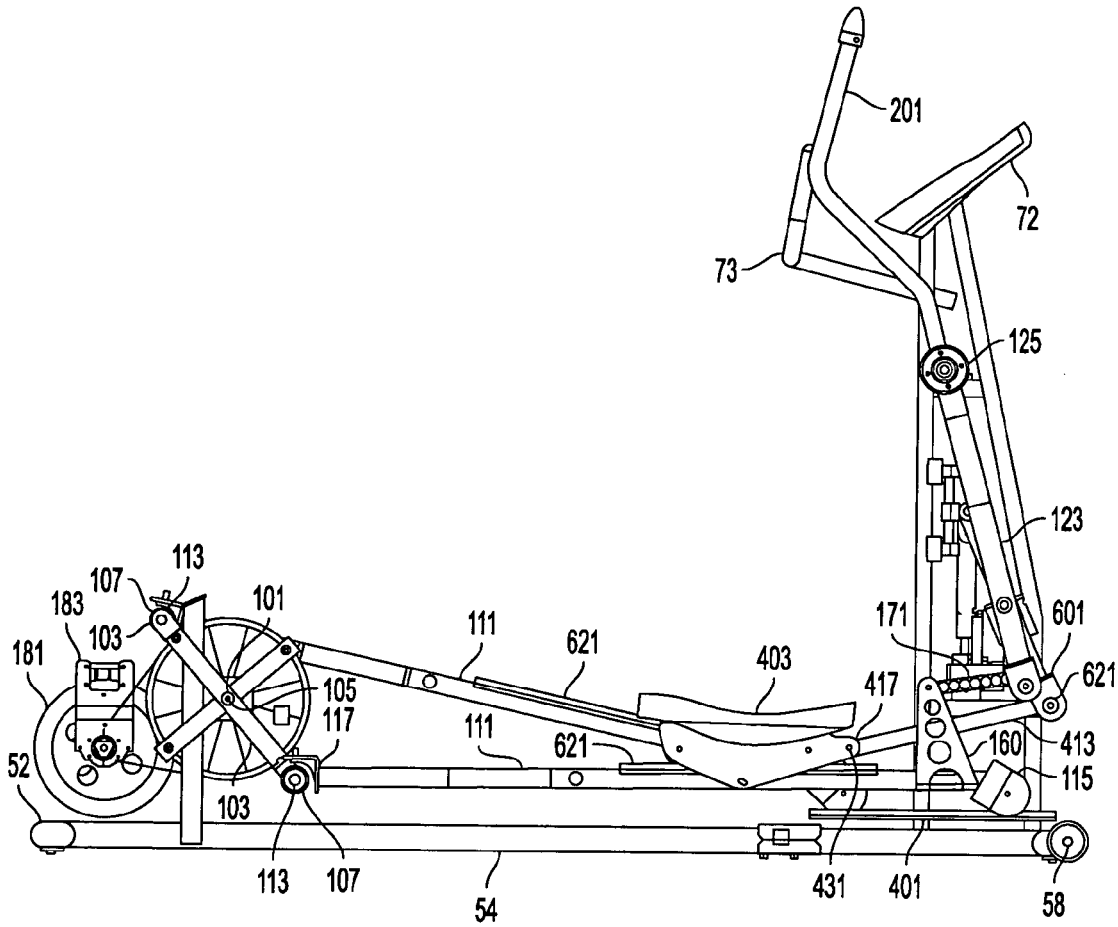

This is made clearer in the simplified representation of FIG. 7. In FIG. 7, a first ellipse (901) is shown corresponding to the motion without any footskate movement using a guide track (401). The second ellipse (903) is the movement where the footskate (403) can only move linearly on the main drive link (111), as can be seen, this ellipse simply has a slightly larger long dimension. The third shape (905) is the motion of the footskate (403) without the inclusion of limiting the motion of the main drive link (111) to a guide track (401) and without any adjustment. As can be seen the third ellipse is slightly taller having a more important vertical component and is slightly kidney shaped. The fourth shape (907), which has a freely swinging footskate (403) on the third ellipse (905), is where the difference becomes clear, when the additional vertical height of the adjustment arm (601) rotation is included, the fourth shape (907) has become vertically increased while also being horizontally increased and is still kidney shaped. This difference becomes more and more noticeable the larger the available stride length is, and the shorter components such as the adjustment arm (601) are made. The depicted embodiment allows for better construction and a more usable machine over an increased range of stride lengths than machines which do not compensate for the vertical change.

From FIG. 7 it should be apparent that the reciprocating footskate (403) allows for an increase in horizontal stride distance without a corresponding increase in vertical stride height because the main drive link (111) constrains the vertical dimension, but not the horizontal dimension. The footskate (403) can traverse the main drive link (111) linearly. FIG. 8 shows multiple positions of an embodiment of the device showing the motion. One of ordinary skill in the art would recognize, that the motion of the actual machine is slightly more complex as the ellipse may not be arranged to be perfectly horizontal. Further, in an alternative embodiment, increasing the vertical component may be included as an option in the machine to allow for a climbing type of motion in addition to simply an increased stride length.

While the above presumes a particular dual arm structure to provide for the reciprocation of the footskate (403) on the main drive link (111), one of ordinary skill in the art would understand that other systems could be used to reciprocate the footskate (403) in the desired manner discussed above. For instance the footskate (403) could be directly moved on the main drive link (111) such as through the use of a motor. These alternatives all form part of the invention.

It may be useful in an embodiment to allow a fixed amount of reciprocation of the footskate (403) simply to adapt elliptical machines to have a more natural foot stride for a greater number of people (or to allow a user to purchase an elliptical machine where the stride length has been preset for them). This embodiment may be accomplished by placing the pendulum arm's (123) axis of rotation (925) and the adjustment arm's (601) axis of rotation (603) a fixed distance apart. In another embodiment, the foot stride length can be altered either by the user (for instance to adapt the machine for multiple different users in sequence) or by the machine itself. In this way the foot stride length for any particular machine is changeable to either automatically adjust to a particular user or to adjust the stride length to provide for variation during a single exercise session. This may be accomplished by allowing the distance between the axes to be varied, or to allow the coupling (605) to move.

To adjust the dimensions of the exercise, one simply needs to be able to adjust either of the distance between the axes (603) and (925), or the distance of the coupling (605) from one of the axes (603) and (925). The device depicted in FIGS. 1–4 is designed to use both adjustments simultaneously. In particular, as can be seen in the detail view of FIG. 4, the rotational bar (931) corresponding to the lower axis is attached to a lift mechanism (933). This may be any type of lift mechanism (933) but in the preferred embodiment is designed to be powered by a hydraulic or pneumatic piston (935) in turn powered by an electric engine (937). The electric engine (937) may be powered by electricity generated by the performance of the exercise, or may be from an external source. In an alternative embodiment, the lift mechanism (933) may be hand cranked, may be lifted between different predetermined positions, or may be moved by any other type of lift mechanism (933) known now or later discovered.

Movement of the rotational bar (931) will serve to move the axes (603) and (925) either closer together or further away to adjust the stride length. Further, particularly when the system is driven by a motor, the stride length can be changed during the exercise session. As should also be apparent from the figure, as the axis (603) of the adjustment arm (601) is moved further away, the adjustment arm (601) slides through the coupler (605) moving the coupler (605) closer to the axis (603) of the adjustment arm (601). This can allow for a smaller machine to offer a wider range of motion than if only one change was made.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. An elliptical exercise machine comprising:

a frame;

a crank arm rotationally connected to said flame at a crank pivot;

a linear guide track attached to said frame;

a main drive link attached at a distal end to said crank arm at a position spaced from said crank pivot; said main drive link attached at a proximal end so that said proximal end will linearly reciprocate in said guide track;

a pendulum arm, connected at a first rotational axis to said frame, the distal end of said pendulum arm being rotationally connected to the proximal end of said main drive link via an interface having two independent rotation points;

a footskate, said footskate capable of reciprocating movement on said main drive link;

an adjustment arm, said adjustment arm connected at a second rotational axis, spaced from said first rotational axis, to said frame, the distal end of said adjustment arm being rotationally attached to said footskate via an interface having two independent rotation points; and a coupling connecting said adjustment arm to said pendulum arm so that when said pendulum arm moves about said first pivot axis, said adjustment arm also moves about said second pivot axis.

2. The machine of claim 1 wherein the position of said first rotational axis is adjustable relative the position of said second rotational axis.

3. The machine of claim 2 further comprising a lift mechanism for adjusting the position of said first rotational axis relative to said second rotational axis.

4. The machine of claim 3 wherein said lift mechanism includes a hydraulic cylinder.

5. The machine of claim 4 wherein said lift mechanism is electrically powered.

6. The machine of claim 4 wherein said lift mechanism is hand powered.

7. The machine of claim 1 wherein said first rotational axis is in a fixed position relative to said second rotational axis.

8. The machine of claim 1 wherein said main drive arm includes a foot track and said footskate reciprocates in said foot track.

9. The machine of claim 1 wherein said first rotational axis is spaced vertically from said second rotational axis.

10. The machine of claim 9 wherein said first rotational axis is not spaced horizontally from said second rotational axis.

11. The machine of claim 1 wherein said pendulum arm is bent away from said flame below said first rotational axis, and said adjustment arm rotates between said pendulum arm and said frame.

12. The machine of claim 1 wherein said crank arm is attached to a flywheel.

13. The machine of claim 1 wherein said crank arm is attached to a resistance.

14. The machine of claim 1 further comprising a computer to control said machine.

15. The machine of claim 1 wherein said coupling is rotationally attached to said pendulum arm.

16. The machine of claim 1 wherein said adjustment arm is rotationally attached to said coupling, and said adjustment arm can slide through said coupling.

17. The machine of claim 1 further comprising:

a second crank arm rotationally connected to said frame at said crank pivot, said second crank arm being arranged in a 180 degree relation to said crank arm;

a second linear guide track attached to said flame;

a second main drive link attached at a second main drive link distal end to said second crank arm at a position spaced from said crank pivot; said second main drive link attached at a second main drive link proximal end so that said second main drive link proximal end will linearly reciprocate in said second guide track;

a second pendulum arm, connected at said first rotational axis to said frame, a distal end of said second pendulum arm being rotationally connected to said second main drive link proximal end via an interface having two independent rotation points;

a second footskate, said second footskate capable of reciprocating movement on said second main drive link;

a second adjustment arm, said second adjustment arm connected at said second rotational axis, spaced from said first rotational axis, to said frame, a distal end of said second adjustment arm being rotationally attached to said second footskate via an interface having two independent rotation points; and a second coupling connecting said second adjustment arm to said second pendulum arm so that when said second pendulum arm moves about said first pivot axis, said second adjustment arm also moves about said second pivot axis.

18. A method of altering the stride length of an elliptical exercise machine during an exercise, the method comprising:

providing an elliptical exercise machine including:

a frame;

a crank arm rotationally connected to said frame at a crank pivot;

a linear guide track attached to said frame;

a main drive link attached at a distal end to said crank arm at a position spaced from said crank pivot; said main drive link attached at a proximal end so that said proximal end will linearly reciprocate in said guide track;

a pendulum arm, connected at a first rotational axis to said frame, the distal end of said pendulum arm being rotationally connected to the proximal end of said main drive link via an interface having two independent rotation points;

a footskate, said footskate capable of reciprocating movement on said main drive link;

an adjustment arm, said adjustment arm connected at a second rotational axis, spaced a first length from said first rotational axis, to said frame, the distal end of said adjustment arm being rotationally attached to said footskate via an interface having two independent rotation points; and a coupling connecting said adjustment arm to said pendulum arm so that when said pendulum arm moves about said first pivot axis, said adjustment arm also moves about said second pivot axis;

having a user on said exercise machine move their feet so that during said exercise said footskate reciprocate on said main drive link a first distance; and altering a position of said second rotational axis so that said second rotational axis is spaced a second length from said first rotational axis, said second length being greater than said first length.

* * * * *